US008286941B2

(12) United States Patent
Fontela et al.

(10) Patent No.: US 8,286,941 B2
(45) Date of Patent: Oct. 16, 2012

(54) RING FOR AEROSOL DISPENSER VALVE

(75) Inventors: Jacques Fontela, Vitot (FR); David Goujon, Saint Leger du Bourg Denis (FR); Christophe Jacuk, Le Vaudreuil (FR)

(73) Assignee: Aptar France SAS, Le Neubourg (FR)

( * ) Notice: Subject to any disclaimer, the term of this patent is extended or adjusted under 35 U.S.C. 154(b) by 1009 days.

(21) Appl. No.: 12/159,297

(22) PCT Filed: Dec. 14, 2006

(86) PCT No.: PCT/FR2006/051362

§ 371 (c)(1),
(2), (4) Date: Sep. 11, 2008

(87) PCT Pub. No.: WO2007/074274

PCT Pub. Date: Jul. 5, 2007

(65) Prior Publication Data

US 2009/0008584 A1 Jan. 8, 2009

(30) Foreign Application Priority Data

Dec. 27, 2005 (FR) ..... 05 54113

(51) Int. Cl.
*F16K 31/00* (2006.01)

(52) U.S. Cl. ... 251/354; 251/339; 251/353; 222/402.23; 222/402.24

(58) Field of Classification Search ..... 251/339, 251/349, 353, 354; 222/402.1, 402.23, 402.24
See application file for complete search history.

(56) References Cited

U.S. PATENT DOCUMENTS

| | | | | |
|---|---|---|---|---|
| 2,818,202 | A * | 12/1957 | Abplanalp | 222/402.24 |
| 3,521,859 | A * | 7/1970 | Gronemeyer | 251/353 |
| 3,958,727 | A * | 5/1976 | Steiman | 222/402.24 |
| 4,475,667 | A * | 10/1984 | Ori et al. | 222/39 |
| 5,027,985 | A * | 7/1991 | Abplanalp | 222/402.1 |
| 7,278,556 | B2 * | 10/2007 | Goujon et al. | 222/402.1 |
| 2004/0129737 | A1 * | 7/2004 | Anderson et al. | 222/402.24 |

FOREIGN PATENT DOCUMENTS

| | | | |
|---|---|---|---|
| EP | 0 692 434 | A2 | 1/1996 |
| EP | 0 774 423 | A1 | 5/1997 |
| EP | 1 415 934 | A1 | 5/2004 |
| FR | 2 738 557 | A1 | 3/1997 |
| WO | WO 96/08284 | * | 3/1996 |

* cited by examiner

*Primary Examiner* — John K Fristoe, Jr.
*Assistant Examiner* — Jessica Cahill
(74) *Attorney, Agent, or Firm* — Sughrue Mion, PLLC

(57) ABSTRACT

A ring for disposing around a valve body of an aerosol dispenser valve that is mounted by a fastener element, such as a crimpable capsule, on a reservoir containing substance to be dispensed, the ring having an outer portion and an inner portion that cooperate with the valve body, and the outer portion having a deformable axial wall portion that extends towards the bottom of the reservoir and that is capable of deforming elastically in a radially-inward direction.

16 Claims, 7 Drawing Sheets

RING FOR AEROSOL DISPENSER VALVE

CROSS-REFERENCE TO RELATED PATENT APPLICATION

This application is a national stage application under 37 C.F.R. §371 of International Patent Application No. PCT/FR2006/051362, filed on Dec. 14, 2006, which claims priority from French Patent Application No. 05/54113, filed on Dec. 27, 2005.

BACKGROUND

1. Field

The present invention relates to a ring for an aerosol dispenser valve.

2. Description of Related Art

It is known to use rings with aerosol dispenser valves, in particular metering valves that are mounted on a reservoir containing the substance to be dispensed. In particular, such rings are used in valves that are suitable for use upsidedown, i.e. with the valve disposed below the reservoir while a dose is being expelled. Such rings generally fulfill two main functions, namely firstly ensuring that a maximum quantity of the substance contained inside the reservoir can be dispensed, by limiting the dead volume situated below the inlet of the valve when said valve is in its upsidedown working position. Secondly, such rings also serve to limit contact between the substance and the neck gasket that is generally disposed between the neck of the reservoir and the fastener hoop or capsule that serves to fasten the valve on the receptacle. By limiting contact between the gasket and the substance contained in the reservoir, the risks of the substance becoming contaminated by extractables that can be leached from said gasket are limited, and also deterioration of the gasket as a result of its contact with the substance, in particular a propellant gas, is limited.

In general, the ring is assembled on the valve body by radially clamping an inner edge of the ring onto said valve body. That configuration presents the drawback that when the radial clamping is too strong, it can deform the valve body over time, and in particular the inside of said body, and that can cause the valve to malfunction. Numerous valves provide a relatively narrow gap between the valve member that slides and the valve body. Radial deformation of the valve body can thus cause friction and even jamming of said valve member. In addition, in order to perform the two above-mentioned functions effectively, the ring is generally in contact, via its outer portion, with a portion of the neck of the reservoir. In particular, when the fastener capsule is a crimpable capsule, the crimping causes the neck of the reservoir to deform radially, thereby increasing the radial compression exerted on the ring. Once again, this increase in the radial compression transmitted to the inner edge of the ring can cause an increase in the stress exerted on the valve body, and can cause said valve body to deform.

BRIEF SUMMARY

An object of the present invention is to provide a ring and an aerosol dispenser device including such a ring that does not have the above-mentioned drawbacks.

More particularly, an object of the present invention is to provide a ring for an aerosol dispenser device that avoids any excessive radial stress on the valve body, thereby avoiding any risk of the valve body deforming excessively, in particular while the valve is being crimped on the reservoir.

Another object of the present invention is to provide such a ring that makes it possible to compensate for dispersion in manufacturing and assembly tolerances, without increasing radial stress on the valve body.

Another object of the present invention is to provide such a ring that maximizes the amount of the content of the reservoir that can be dispensed.

Another object of the present invention is to provide such a ring that minimizes contact between the neck gasket and the substance contained in the reservoir.

Another object of the present invention is to provide such a ring that is simple and inexpensive to manufacture and to assemble.

The present invention thus provides a ring for disposing around a valve body of an aerosol dispenser valve that is mounted by means of a fastener element, such as a crimpable capsule, on a reservoir containing substance to be dispensed, said ring comprising at least an outer portion and an inner portion that co-operates with said valve body, said outer portion comprising a deformable axial wall portion that extends towards the bottom of the reservoir and that is capable of deforming elastically in a radially-inwards direction.

Advantageously, said ring includes a radially-inner portion that co-operates with a portion of the valve body, and a second inner portion that co-operates with another portion of the valve body.

A peripheral gap, such as a groove, is advantageously provided radially inside said deformable wall, so as to enable said deformable wall to deform radially inwards.

Advantageously, said peripheral gap is separated from said radially-inner portion by a central axial wall, said central wall being provided with at least one radial through groove that connects said peripheral gap to said radially-inner portion.

Advantageously, said central axial wall is provided with a plurality of radial through grooves.

Advantageously, said central axial wall includes a radially-outer rear face that is substantially axial, and a radially-inner front face that slopes, which sloping front face connects the top of said central axial wall to said radially-inner portion.

Advantageously, said peripheral gap and said at least one radial groove include a bottom surface in common.

Advantageously, the side walls of said at least one radial through groove are substantially axial.

In a variant, said at least one radial through groove has side walls that slope.

Advantageously, said outer portion is adapted to co-operate with a portion of said reservoir.

After said fastener element has been assembled on the reservoir, said outer portion advantageously co-operates in leaktight manner with a portion of the reservoir, so as to prevent any contact between the substance to be dispensed and a neck gasket disposed between the reservoir and the fastener element.

The ring advantageously includes only a single inner portion in contact with the valve body.

Advantageously, said ring makes no contact with the neck gasket.

Advantageously, said ring is in contact with said neck gasket, and, after the fastener element has been fastened on the reservoir, the deformed axial wall portion urges the ring against said neck gasket so as to improve sealing.

Advantageously, said neck gasket is disposed at a distance from the valve body, the contact surface between said neck gasket and said ring being small.

Advantageously, said ring is made integrally with said valve body at an inner portion of the ring that forms a connection piece.

Advantageously, the outside surface of the deformable axial wall portion is substantially smooth, preferably mirror-polished, before fastening the fastener element.

The present invention also provides an aerosol dispenser device comprising a reservoir containing substance to be dispensed, an aerosol valve, and a ring as described above.

Advantageously, said valve body includes at least one opening so as to enable substance to pass from the reservoir into said valve, said bottom surface of said peripheral gap and of said radial grooves being situated at the bottom edge of said opening, in the upsidedown working position, with the valve disposed below said reservoir.

BRIEF DESCRIPTION OF THE DRAWINGS

These characteristics and advantages and others of the present invention appear more clearly from the following detailed description of several embodiments thereof, given as non-limiting examples, and with reference to the accompanying drawings, in which.

DETAILED DESCRIPTION

Figure 1:
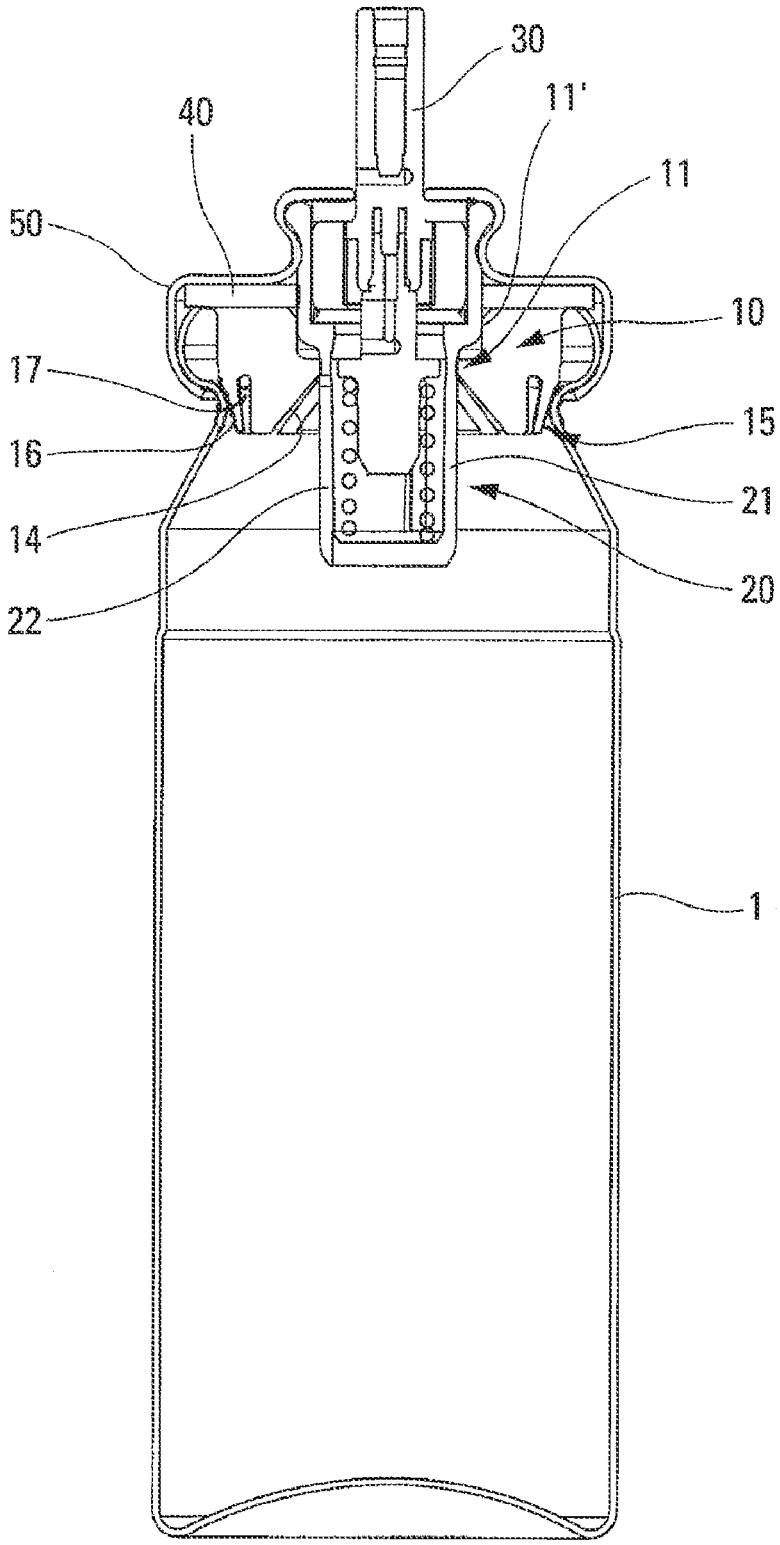
FIG. 1 is a diagrammatic section view of an aerosol dispenser device in a top-up position and including a ring constituting a first embodiment of the present invention.

With reference more particularly to FIG. 1, the aerosol device includes a reservoir 1 containing substance to be dispensed. The substance can be of the pharmaceutical type, and propellant gas can be provided for dispensing the substance through an aerosol valve 20, preferably a metering valve. The aerosol valve includes a valve body 21 in which a valve member 30 slides. The valve body 21 is assembled on the neck of the reservoir 1 by means of a fastener hoop or capsule 50, in particular of the crimpable type, preferably with a neck gasket 40 interposed therebetween for sealing purposes. In particular, the valve shown is for being used upsidedown, i.e. while a dose is being expelled, the valve is situated below the reservoir. The valve could also be a valve suitable for use in the on-top position. The valve body would then be fitted with a tube for bringing the liquid to the chamber via the valve body. The valve body 21 includes one or more openings 22 making it possible to fill the valve with substance from the reservoir. The openings are shown in the form of lateral longitudinal slots 22 that extend over a fraction of the height of the valve body 21. In a variant, one or more openings of different shapes could be provided for this purpose.

In the invention, a ring 10 is assembled around the valve body 21. The ring 10 performs two main functions, namely, firstly ensuring that the reservoir is emptied as much as possible by minimizing the dead volume situated below the bottom edge of the opening(s) 22 of the valve body 21 when the valve is in its upsidedown working position. Secondly, the ring also serves to minimize contact between the neck gasket 40 and the substance contained in the reservoir 1. The ring can advantageously prevent any contact between the substance and the neck gasket 40 by forming a seal with a portion of the reservoir after the capsule 50 has been crimped on.

The ring 10 includes at least one inner portion 11 for co-operating with the valve body 21. The inner portion 11 is preferably the radially-innermost portion of the ring 10. A second inner portion 11' is advantageously provided to co-operate with another portion of the valve body. This configuration makes it possible to distribute the radial stress exerted by the ring 10 on the valve body 21 over two fastener zones instead of one, thereby firstly limiting the radial stress exerted on each of said zones individually, and secondly making it possible to avoid substantially any sliding of the ring 10 on the body 21, said ring being clamped against said body at two distinct locations. The ring 10 also makes it possible to limit contact between the neck gasket 40 and the substance contained in the reservoir 1.

The ring 10 includes an outer portion 15, preferably its radially-outermost portion, that includes a deformable axial wall portion 16 that is capable of deforming elastically in a radially-inward direction. In particular, the purpose of the deformable wall 16 is to compensate for and to absorb any radial stress that might be exerted thereon by the reservoir 1, in particular at the moment when the fastener capsule 50 is being crimped on, by said wall deforming radially inwards. Starting from a top portion of the ring (in the position shown in FIGS. 1 to 4) that is in contact with, or in the proximity of, the neck gasket 40, the deformable wall 16 extends axially towards the bottom of the reservoir. This configuration makes it easier to assemble the ring around the valve body 21. It also makes it possible to provide the ring with dimensions such that the deformable portion is deformed only while the capsule 50 is being crimped, and not while the ring is being assembled around the valve body, nor while the valve is being inserted into the reservoir, since that might cause the ring to move axially along the valve body. In addition, this specific shape with the deformable wall 16 pointing towards the bottom of the reservoir enables said deformable wall to participate in guiding substance towards the opening(s) 22 of the valve body, as can be seen in particular in FIG. 4. During crimping, contact between the reservoir and the deformable wall 16 is advantageously made in a zone of the deformable wall that is easily deformed. In the embodiment shown in FIG. 1, the zone is situated approximately in the middle of said deformable wall 16. The zone could be axially offset, but preferably it should not be situated right at the start of the wall where its capacity to deform elastically is small, or even non-existent.

Another advantage of a deformable wall that is directed towards the bottom of the reservoir is that, in an embodiment in which the neck gasket 40 is in contact with the ring 10, the ring 10 is urged axially or thrust against said gasket 40 after crimping. After deforming, the wall 16 exerts a force having a component that is axial and that is directed towards the gasket. This improves the fastening of the ring 10 on the valve body 21. In addition, the stress of the neck gasket 40 improves sealing with an improved distribution of stress over the gasket, in particular while the capsule is being clamped. If the deformable wall were directed in the opposite direction, the ring would, on the contrary, be urged away from the gasket once the wall is deformed. The ring 10 would therefore need to be fastened more securely on the valve body 21, so as to compensate, thereby increasing the risk of having a negative effect on the valve body. In addition, sealing at the neck gasket 40 would not be improved.

Advantageously, the outside surface of the outer portion 15, in particular of the deformable axial wall portion 16, is smooth, preferably mirror-polished, i.e. with a roughness index that is less than 1.0, advantageously less than 0.8, and preferably about 0.05. This configuration promotes leaktight contact between the reservoir and the ring after crimping.

As a result of the ring 10 including a deformable wall portion 16, deformation of the reservoir 1 is not automatically transmitted to the inner edge(s) 11 and 11' of said ring, and consequently is not automatically transmitted to the valve body 21. Any risk of the valve body 21 deforming, that would in turn risk causing the valve to jam or malfunction, is thus avoided. In addition, after deforming, contact between the deformable wall and the reservoir can create peripheral sealing that prevents any contact between the substance and the neck gasket 40. This eliminates any risk of contamination of the substance to be dispensed.

Various advantageous variant embodiments can be envisaged, some of which are shown in FIGS. 5 to 11.

Figure 4:
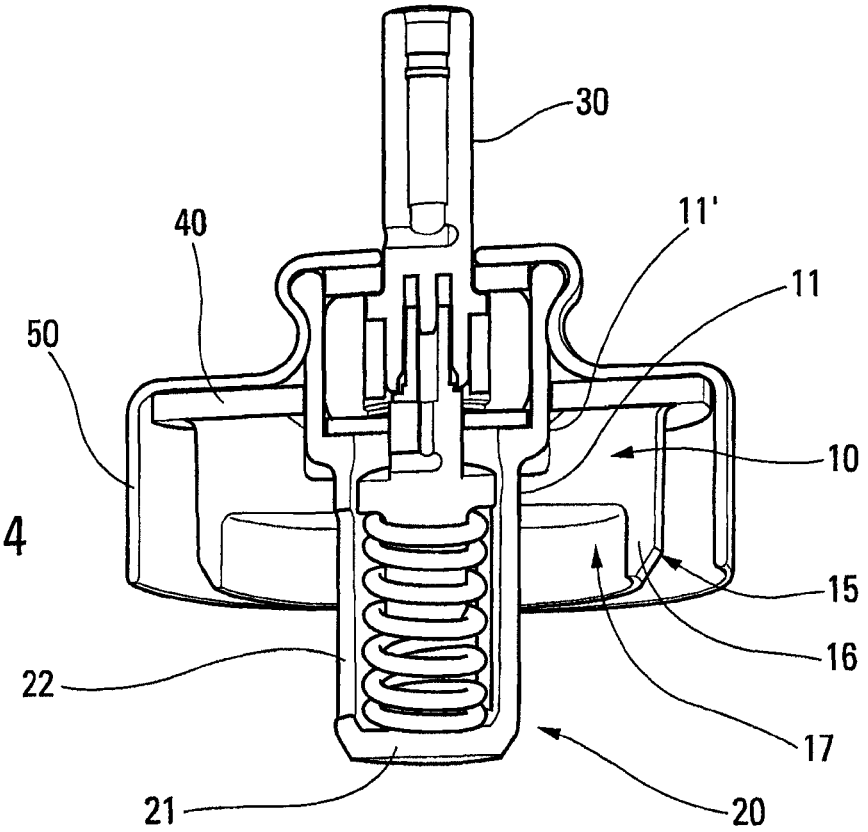
FIG. 4 is a view similar to the view in FIG. 3 showing a ring constituting another variant embodiment of the present invention.
Figure 11:
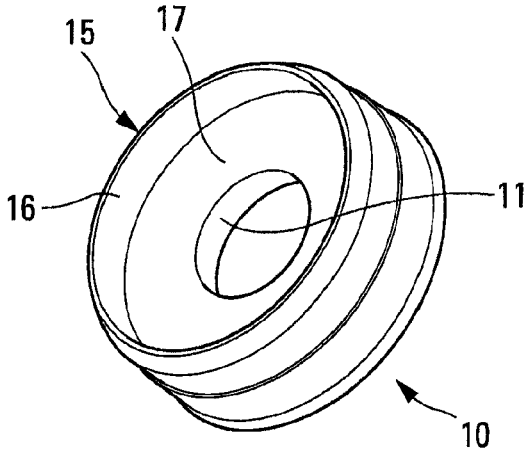

FIG. 11 shows the simplest version. In this variant embodiment, the deformable axial wall portion 16 forms the radially-outer portion 15 of the ring 10 and is extended radially inwards by a peripheral gap 17 that extends towards the radially-inner edge 11. As can be seen in FIG. 11, the peripheral gap 17, disposed radially inside the deformable wall 16, makes it possible to deform the deformable wall 16 radially inwards. In the variant in FIG. 11, the peripheral gap 17 is defined merely by an end surface. As can be seen in FIG. 4 that shows a valve receiving a ring made in accordance with the FIG. 11 embodiment, the end surface of the peripheral gap 17 can be horizontal in the position shown in FIG. 4, or it can slope a little. The end surface advantageously terminates at said radially-inner portion 11 substantially at the top edge of the opening 22 of the valve body 21, as shown in FIG. 4. In the upright position shown in FIG. 4, the top edge of the opening 22 obviously corresponds to the bottom edge of the same opening 22 in the upsidedown working position of the valve. This guarantees that the substance contained inside the reservoir is emptied as much as possible by limiting, or even by eliminating, any dead volume of substance when the valve is in the upsidedown working position. A slightly sloping end surface for the peripheral gap 17 further enhances this function.

In the other embodiments shown in FIGS. 5 to 10, the ring 10 further includes a central axial wall 19 that separates said radially-inner portion 11 from said peripheral gap 17 and from said deformable axial wall portion 16 that forms the outer portion 15 of the ring 10. The central axial wall 19 is thus provided with at least one radial through groove 12 for connecting said peripheral gap 17 to said radially-inner portion 11. The function of the at least one radial through groove 12 is merely to avoid substance stagnating inside said peripheral gap 17 that is provided so as to enable the deformable wall 16 to deform radially. This makes it possible to minimize the dead volume of substance when the valve is in the upsidedown working position.

Figure 2:
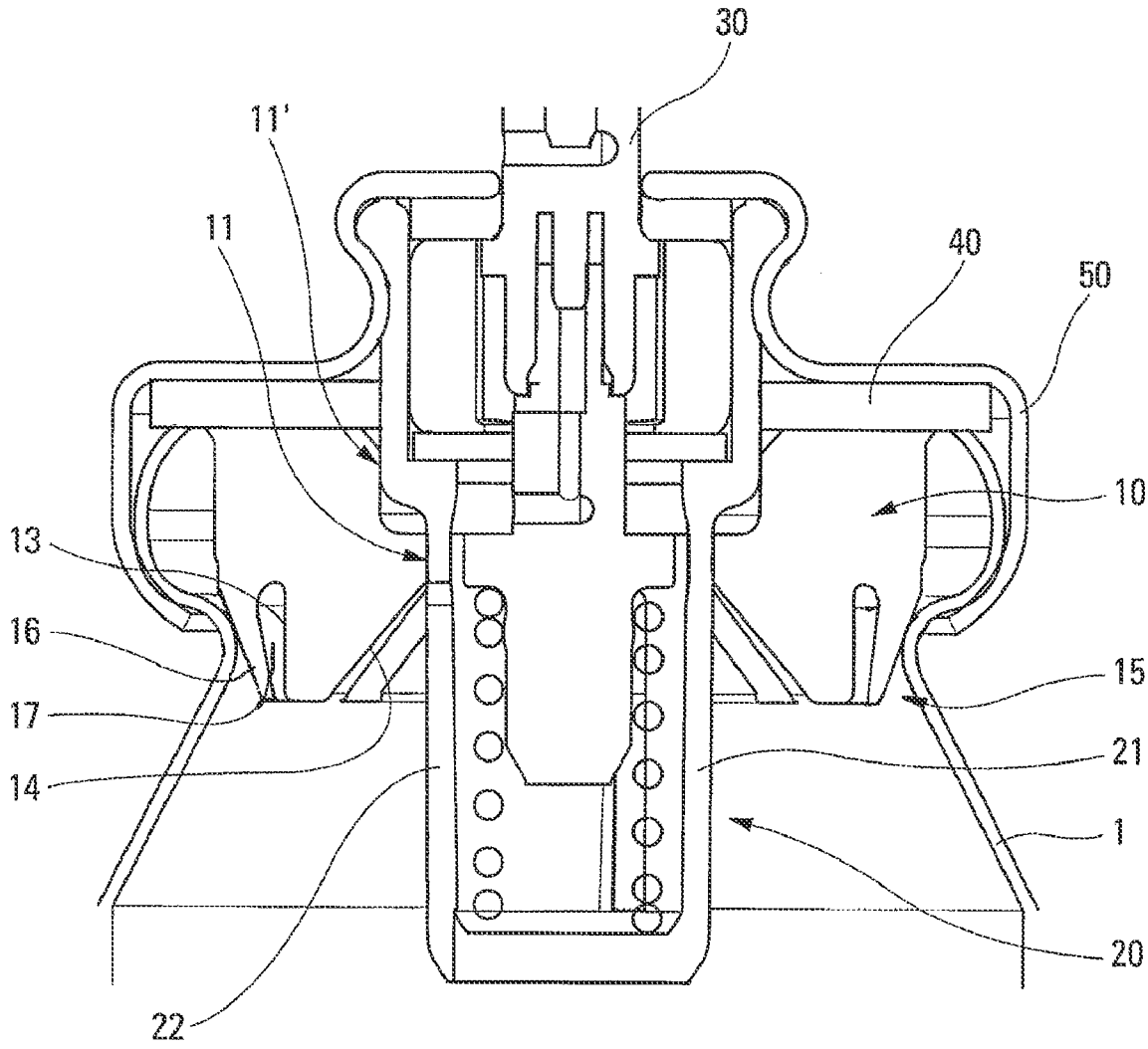
FIG. 2 is a larger-scale view of a detail of a portion of the FIG. 1 device.
Figure 3:
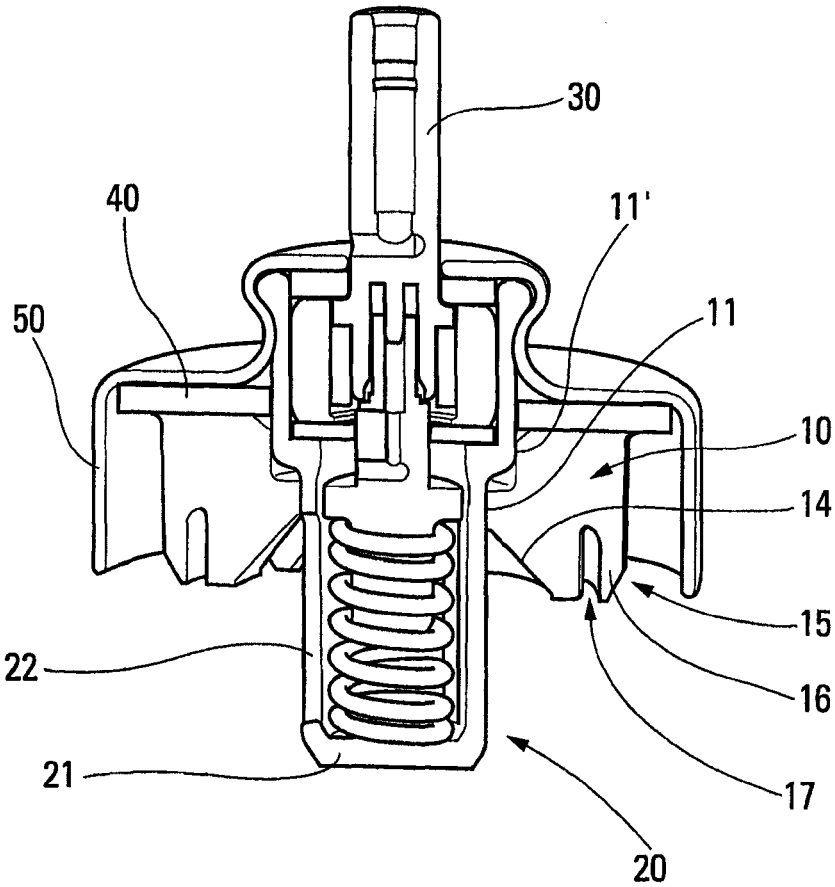
FIG. 3 is a diagrammatic and partially cut-away perspective view showing, in section, a ring mounted on a valve, constituting a variant embodiment of the invention.

Advantageously, said central axial wall 19 includes a radially-outer rear face 13 that is substantially axial, i.e. substantially vertical in the upright position shown in particular in FIG. 2, and a radially-inner front face 14 that advantageously slopes, preferably connecting the top of said central axial wall 19 to said radially-inner portion 11. This configuration that is clearly visible in FIGS. 5 to 10, makes it possible to ensure that the substance is guided towards said radially-inner edge 11 of the ring 10, and consequently towards the opening 22 provided in the valve body 21. In particular, this is clearly visible in FIG. 3, in which it should be observed that the radially-inner edge 11 of the ring is disposed substantially at the top edge (in the upright position) of said side opening 22 of the valve body 21.

Figure 6:
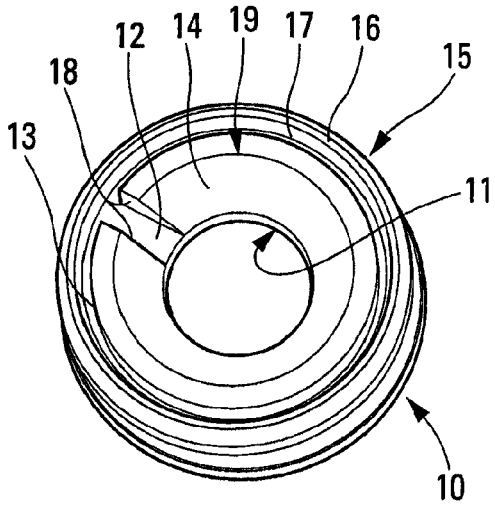
FIGS. 6 to 11 show six variant embodiments of a ring of the present invention.
Figure 7:
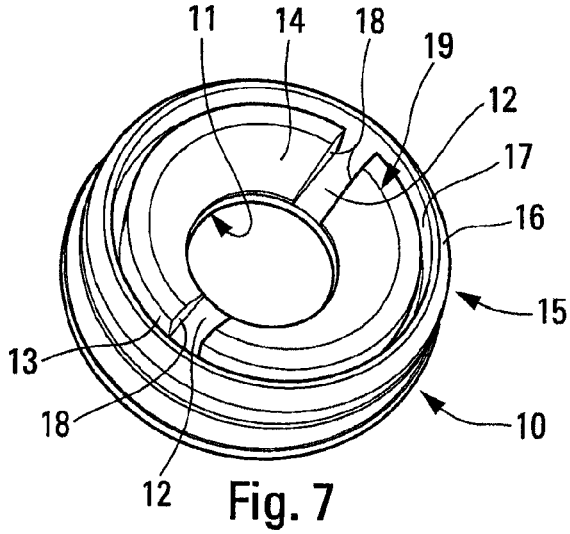
Figure 8:
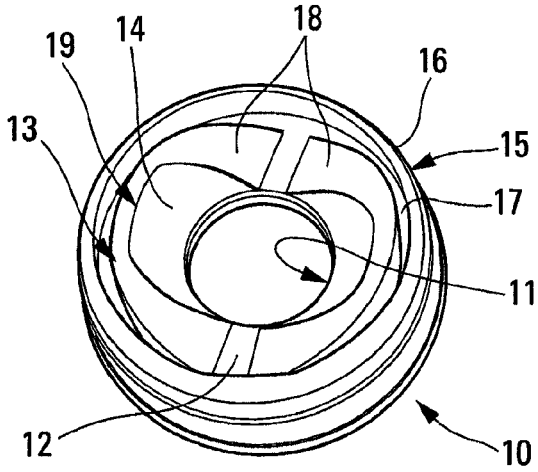
Figure 9:
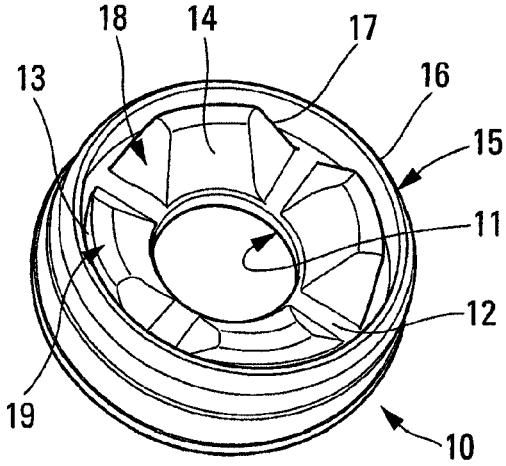
Figure 10:
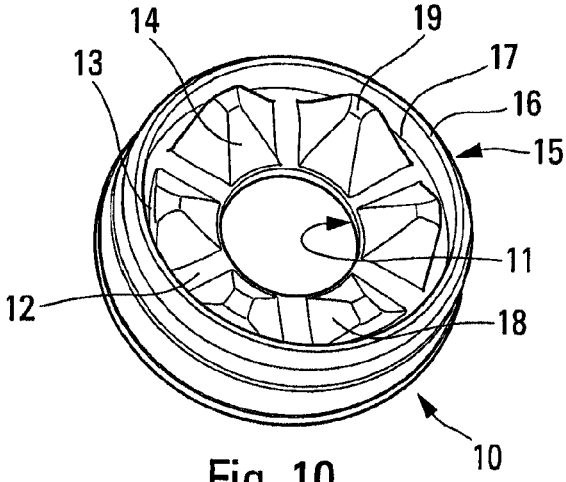

FIG. 6 shows a ring 10 with a single radial through groove 12, whereas FIGS. 7 and 8 show a ring with two radial through grooves 12 that are advantageously diametrically opposite. FIG. 9 shows such a ring with four radial through grooves 12, and FIG. 10 shows a ring with six radial through grooves 12. Naturally, it is possible to have any number of grooves 12. It should be observed that the peripheral gap 17 and the radial groove(s) 12 advantageously include a common end surface that, as in the FIG. 11 variant, can either be substantially plane, or slightly sloping so as to encourage the substance to be guided towards the opening 22 of the valve body, in the upsidedown working position.

Figure 5:
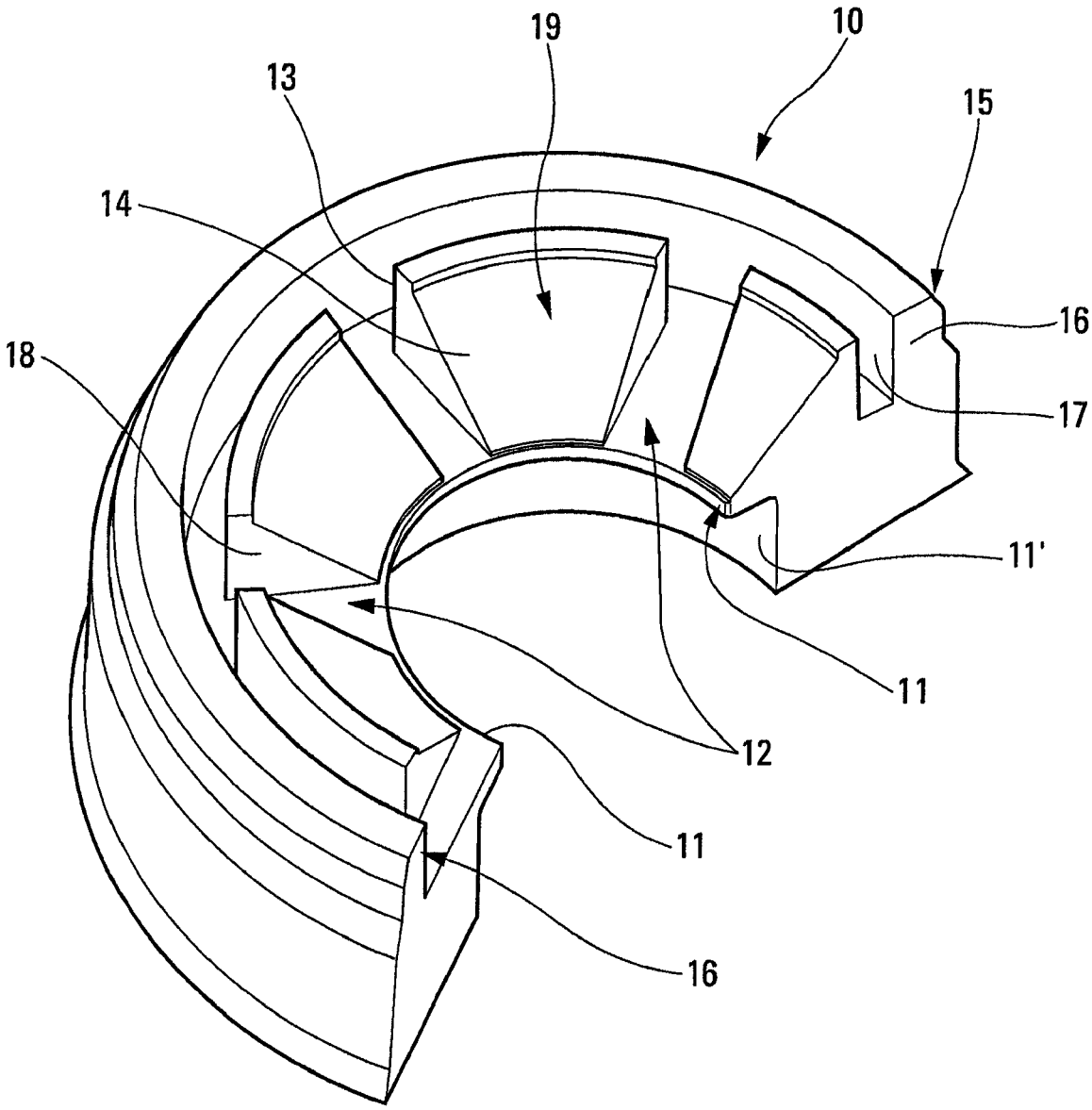
FIG. 5 is a diagrammatic perspective view of a portion of a ring for assembling around an aerosol valve.

As shown in FIGS. 5, 6, and 7, the radial through groove(s) 12 can include side walls 18 that are substantially axial, i.e. substantially vertical in the upright position. In a variant, as shown in FIGS. 8, 9, and 10, the side walls 18 can slope to a greater or lesser extent. In particular, FIG. 8 shows walls that slope greatly, this embodiment particularly encouraging substance to flow towards the opening(s) 22 of the valve body 21 when the valve is in the upsidedown working position.

Figure 12:
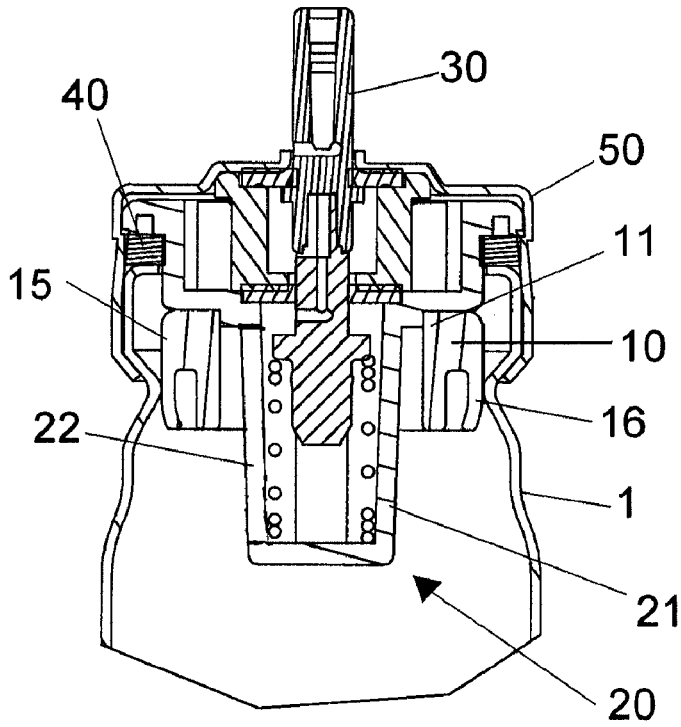
FIG. 12 is a diagrammatic section view of another embodiment of the invention.
Figure 13:
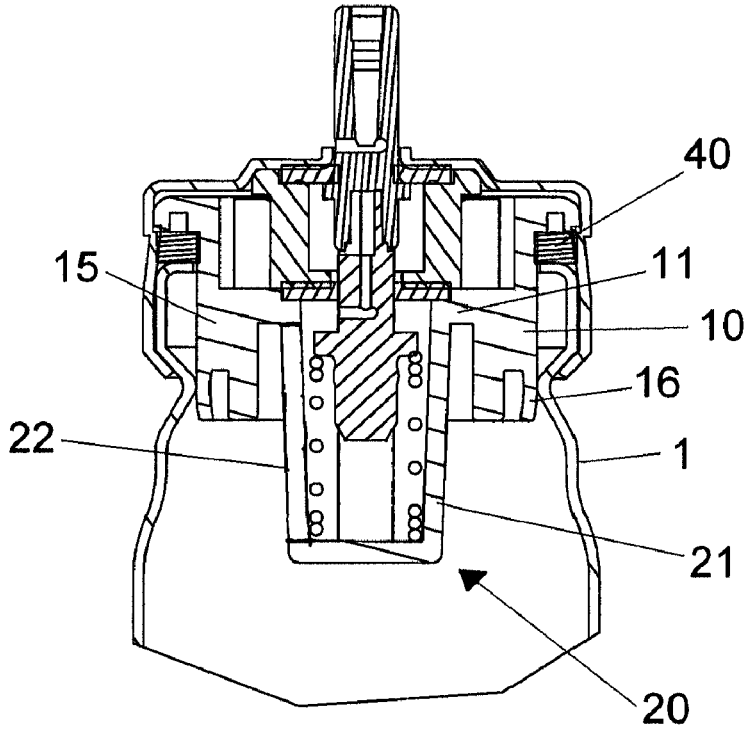
FIG. 13 is a diagrammatic section view of still another embodiment of the invention.
Figure 14:
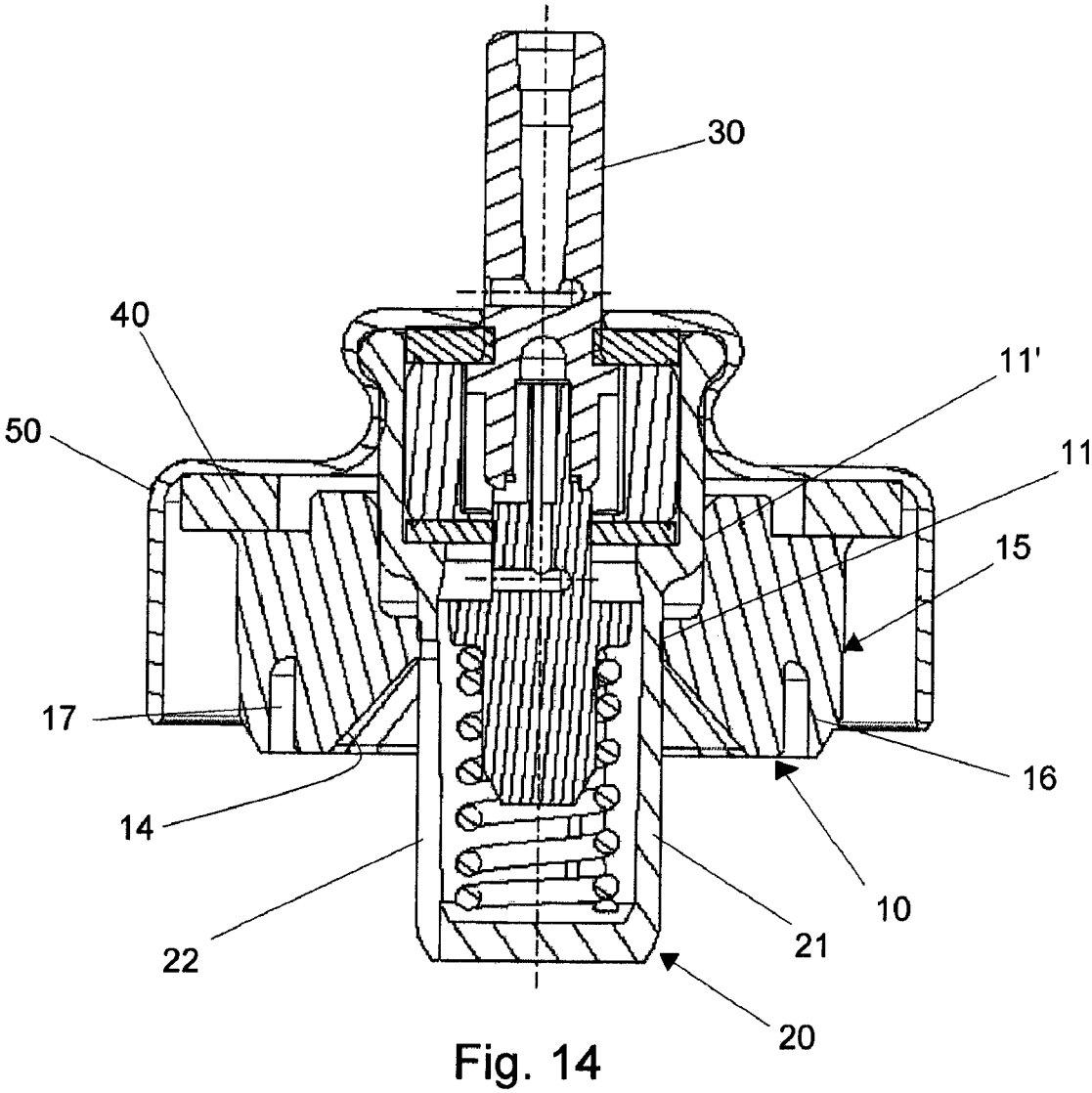
FIG. 14 is a diagrammatic section view of still another embodiment of the invention.

FIGS. 12, 13, and 14 show other embodiments of the invention.

In FIG. 12, the ring 10 is not in contact with the neck gasket 40 that is fastened directly between the valve body 21 and the reservoir 1. The ring 10 can be in peripheral leaktight contact with the reservoir 1 at its outer portion 15, after the capsule 50 has been crimped on. The ring of this variant preferably includes only one contact point 11 with the valve body 21, which contact point can be provided at a radial shoulder of said valve body. The advantage of this variant is that the ring has a very simple shape that is therefore easy and inexpensive to make.

In FIG. 13, the ring 10 is made integrally with the valve body 21, the inner portion 11 of the ring forming a connection piece. This configuration simplifies assembly of the valve, since it eliminates the step of assembling the ring on the valve body.

In FIG. 14, the neck gasket 40 is in contact with the top surface of the ring 10, but it is small in size, not being in contact with the valve body 21. The contact surface between the gasket 40 and the ring 10 is therefore also small. This embodiment reduces the quantity of material required for the gasket, thereby saving cost, and it makes it possible to limit even further the risks of the substance becoming contaminated in the event of coming into contact with the gasket.

Although the present invention is described above with reference to several variant embodiments thereof, as shown in the drawings, the invention is naturally not limited to those variants, but, on the contrary, any useful modifications could be applied thereto by the person skilled in the art. In particular, the valve could be of any structure. In addition, the shapes of the valve body and of the openings could be different from the shapes shown. The same applies to the reservoir, and in particular to its neck, and to the fastener hoop or capsule that could be made differently, e.g. by snap-fastening or screw-fastening. In general, any modification is possible without going beyond the ambit of the present invention as defined by the accompanying claims.

The invention claimed is:

1. An aerosol dispenser device comprising:

a reservoir containing substance to be dispensed;

an aerosol valve, said aerosol dispenser valve comprising a valve body and a valve member sliding in said valve body, the valve body being assembled by a fastener element on the reservoir; and a ring assembled around said valve body, said ring comprising at least an outer portion and an inner portion that co-operates with said valve body, said outer portion comprising a deformable axial wall portion that extends towards the bottom of the reservoir and that is capable of deforming elastically in a radially-inward direction, said valve body including at least one opening so as to enable substance to pass from the reservoir into said valve, a bottom surface of said ring being situated at a bottom edge of an opening, in an upside-down working position, with the valve disposed below said reservoir.

2. The device according to claim 1, wherein the inner portion comprises a first radially-inner portion that co-operates with a portion of the valve body and a second inner portion that co-operates with another portion of the valve body.

3. The device according to claim 1, in which said outer portion is adapted to co-operate with a portion of said reservoir.

4. The device according to claim 1, in which, after said fastener element has been assembled on the reservoir, said outer portion co-operates in leak-tight manner with a portion of the reservoir, so as to prevent any contact between the substance to be dispensed and a neck gasket disposed between the reservoir and the fastener element.

5. The device according to claim 1, in which, the outside surface of the deformable axial wall portion is substantially smooth before fastening the fastener element.

6. The device according to claim 1, in which the ring includes only a single inner portion in contact with the valve body.

7. The device according to claim 6, in which said ring makes no contact with a neck gasket.

8. The device according to claim 1, in which said ring is in contact with said neck gasket, and, after the fastener element has been fastened on the reservoir, the deformed axial wall portion urges the ring against said neck gasket so as to improve sealing.

9. The device according to claim 8, in which said neck gasket is disposed at a distance from the valve body.

10. The device according to claim 1, in which a peripheral gap is provided radially inside said deformable axial wall portion, so as to enable said deformable axial wall portion to deform radially inwards.

11. The device according to claim 10, in which said peripheral gap is separated from said inner portion by a central axial wall, said central axial wall being provided with at least one radial through groove that connects said peripheral gap to said inner portion.

12. The device according to claim 11, in which said central axial wall is provided with a plurality of radial through grooves.

13. The device according to claim 11, in which said central axial wall includes a radially-outer rear face that is substantially axial, and a radially-inner front face that slopes, which sloping front face connects a top of said central axial wall to said inner portion.

14. The device according to claim 11, in which said peripheral gap and said at least one radial groove include a bottom surface in common.

15. The device according to claim 11, in which side walls of said at least one radial through groove are substantially axial.

16. The device according to claim 11, in which said at least one radial through groove has side walls that slope.

* * * * *